US009991624B2

(12) United States Patent
Schlegel

(10) Patent No.: US 9,991,624 B2
(45) Date of Patent: Jun. 5, 2018

(54) MODULAR PLUG CONNECTOR

(71) Applicant: HARTING Electric GmbH & Co. KG, Espelkamp (DE)

(72) Inventor: Bernard Schlegel, Rahden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days. days.

(21) Appl. No.: 15/567,356

(22) PCT Filed: Apr. 18, 2016

(86) PCT No.: PCT/DE2016/100182
§ 371 (c)(1),
(2) Date: Oct. 17, 2017

(87) PCT Pub. No.: WO2016/173581
PCT Pub. Date: Nov. 3, 2016

(65) Prior Publication Data

US 2018/0115103 A1 Apr. 26, 2018

(30) Foreign Application Priority Data

Apr. 27, 2015 (DE) ..... 10 2015 106 416

(51) Int. Cl.
*H01R 13/514* (2006.01)
*H01R 13/655* (2006.01)

(52) U.S. Cl.
CPC ..... *H01R 13/514* (2013.01); *H01R 13/655* (2013.01)

(58) Field of Classification Search
CPC ... H01R 13/518; H01R 13/514; H01R 13/655
See application file for complete search history.

(56) References Cited

U.S. PATENT DOCUMENTS 4,732,568 A * 3/1988 Hall ..... H01R 13/6592 439/607.28
5,240,424 A * 8/1993 Honma ..... H01R 13/639 439/95

(Continued)

FOREIGN PATENT DOCUMENTS

DE 296 01 998 U1 5/1996
DE 296 02 740 U1 5/1996

(Continued)

OTHER PUBLICATIONS

German Office Action, dated Dec. 16, 2015, for German Application No. 10 2015 106 416.2, 5 pages.

(Continued)

*Primary Examiner* — Briggitte R Hammond
(74) *Attorney, Agent, or Firm* — Seed IP Law Group LLP

(57) ABSTRACT

The disclosure relates to a modular plug connector comprising a metal housing and an insulating holding frame received therein. At least one plug connector module is received in the holding frame, comprises a metallic or at least electrically conductive material, and is electrically insulated from the housing by the holding frame. Furthermore, an earthing device, which bridges the holding frame and permits an electrical contact between the plug connector module and the metal housing, is provided on the plug connector module. This allows different plug connector modules to be held in the holding frame insulated from the housing, and at the same time others to be held in electrical contact with the housing.

9 Claims, 3 Drawing Sheets

(56) References Cited

U.S. PATENT DOCUMENTS

| | | | | |
|---|---|---|---|---|
| 5,741,161 | A * | 4/1998 | Cahaly | H01R 9/223 439/637 |
| 6,004,163 | A | 12/1999 | Behling et al. | |
| 9,035,193 | B2 * | 5/2015 | Kagimura | H05K 1/0263 174/251 |
| 2010/0307294 | A1 * | 12/2010 | Schlegel | F16B 41/002 81/44 |
| 2016/0336677 | A1 | 11/2016 | Herbrechtsmeier | |

FOREIGN PATENT DOCUMENTS

| | | | | |
|---|---|---|---|---|
| DE | 102010022690 | A1 * | 12/2011 | H01R 4/64 |
| DE | 10 2013 108 383 | A1 | 2/2015 | |

OTHER PUBLICATIONS

International Search Report and Written Opinion, dated Jul. 14, 2016, for International Application No. PCT/DE2016/100182, 13 pages. (with English Translation of Search Report).

International Preliminary Report on Patentability, dated Oct. 31, 2017, for International Application No. PCT/DE2016/100182, 7 pages. (English Translation).

* cited by examiner

MODULAR PLUG CONNECTOR

BACKGROUND

Technical Field

This disclosure relates to a modular plug connector and, more particularly, to a modular plug connector comprising a metal housing, an electrically insulating retaining frame, and at least one plug connector module inserted into the retaining frame, wherein the retaining frame is arranged in the housing, and wherein the at least one plug connector module is made from a metal or at least electrically conductive material, forms a plug side and a connection side, and at least one electrical contact is accommodated in the plug connector module.

Description of the Related Art

Modular plug connectors of the aforementioned type are required in order to be able to provide a plug connector with a modular construction. A plurality of different plug connector modules can be inserted, in any desired combination, in a retaining frame. The retaining frame holds the plug connector modules together and fixes them relative to one another. The retaining frame can then be inserted into a plug connector housing and fixed therein. A modular plug connector is thus formed from a plug connector housing, a retaining frame, and at least one plug connector module. The modular plug connector can be connected to an appropriate, likewise modular mating plug connector.

Multiple individual plug connectors can be combined and assembled using this type of modular plug connectors. Different standardized plug connector modules and a retaining frame described in this disclosure are all that is needed.

DE 10 2013 108 383 A1 describes an electric plug connector module which is provided separately or in combination with other plug connector modules to form a modular plug connector. The electric plug connector module has an electric contact means which is connected, inside the electric plug connector module, in an electrically conductive fashion to an electric contact accommodated therein and is guided to the outside of the electric plug connector module.

In a specific embodiment of such modular plug connectors, the retaining frame is manufactured from an electrically insulating material, preferably plastic. They can be produced more favorably using an injection-molding method than retaining frames which are made from a metallic material.

It is, however, a disadvantage in the case of these devices that there is no electrical contact between the plug connector modules and the plug connector housing. The plug connector modules are coupled electrically by the plug connector housing owing to the insulating material.

In the case of plug connector modules which accommodate a PE contact, it is, however, necessary to connect them electrically to the plug connector housing in order to achieve grounding of all required components.

BRIEF SUMMARY

Embodiments of the present invention provide a modular plug connector which, on the one hand, has advantageous components made from plastic and, on the other hand, cleverly circumvents the insulating properties of plastic and hence permits an electrical connection of individual plug connector modules to the plug connector housing in spite of the insulating retaining frame.

This disclosure relates to a modular plug connector. The modular plug connector includes a metal housing, an electrically insulating retaining frame, and at least one plug connector module. The plug connector module is held in the retaining frame. This in turn is arranged in the plug connector housing.

The plug connector module is designed as a so-called PE module and houses a grounding contact inside a metal housing. The housing can alternatively also be made from a different electrically conductive material. The plug connector module generically has a plug side and a connection side, it being possible in each case to access the grounding contact arranged in the plug connector module.

According to embodiments of the present invention, the modular plug connector has a grounding device which connects the plug connector module and the housing to each other in an electrically conductive manner. For this purpose, the grounding device is formed from a flat fastening flange on which a spring arm is integrally formed.

The fastening flange is designed such that it can be placed onto the plug connector module on the connection side of the latter and can be connected to said plug connector module. The fastening flange is expediently fastened to the plug connector module by at least one screw.

The spring arm projects from the fastening flange approximately at right angles toward the plug side of the plug connector module. It has a free end which has a U-shaped design so that the end of the spring arm projects back toward the connection side of the plug connector module.

The spring arm is designed such that it touches the housing of the plug connector and makes an electrical connection with the latter. To do this, the spring arm projects over the retaining frame to the housing. The spring arm preferably engages in a pocket in the housing. The pocket is here designed as a recess in the housing which has at least two opposite sides. The U-shaped end of the spring arm can thus be clamped positively in the housing.

In a specific embodiment, one of the opposite sides of the pocket on the housing is designed as a grounding plate which is attached to the housing. The grounding plate is thus simultaneously contacted by the grounding device with the housing at a further location.

BRIEF DESCRIPTION OF THE SEVERAL VIEWS OF THE DRAWINGS

Exemplary embodiments are shown in the drawings and explained in detail below. In the drawings.

DETAILED DESCRIPTION

The figures contain partially simplified schematic views. In part, identical reference numbers are used for identical (but possibly also non-identical) elements. Different views of the same elements could be at a different scale.

Figure 1:
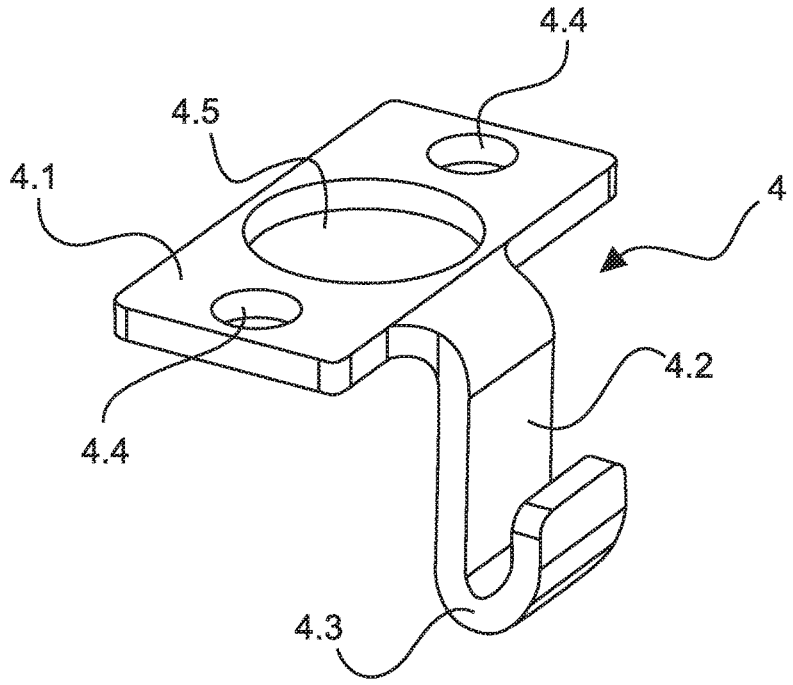
FIG. 1 shows a grounding device according to the disclosure.

FIG. 1 shows a grounding device 4 according to an example embodiment of the invention for use in a modular plug connector according to the present disclosure. The grounding device 4 includes a fastening flange 4.1 with a spring arm 4.2 leading from the fastening flange 4.1. The fastening flange 4.1 has two fastening bores 4.4. The fastening bores 4.4 serve to receive fastening devices, for example screws, by way of which the fastening flange 4.4 can be fastened to a plug connector module 3 (FIG. 2) of a modular plug connector.

A contact opening 4.5 is provided between the fastening bores 4.4 shown. The contact opening 4.5 serves only for the passage of a contact element 5 which is accommodated in the plug connector module 3, to which the grounding device 4 is in turn attached.

The spring arm 4.2 extends approximately at a right angle to the fastening flange 4.1 and has a free end 4.3. This means that the spring arm 4.2 and fastening flange 4.1 form an angle of approximately 90° relative to each other. In an advantageous embodiment, the angle that the spring arm 4.2 and the fastening flange 4.1 form relative to each other is slightly smaller, preferably between 80° and 90°.

The free end 4.3 of the spring arm 4.2 has an approximately U-shaped design and thus extends at least in places approximately parallel to the remainder of the spring arm 4.2. The grounding device 4 is preferably produced from a springy elastic plate. However, the grounding device 4 is at least produced from an electrically conductive material.

Figure 2:
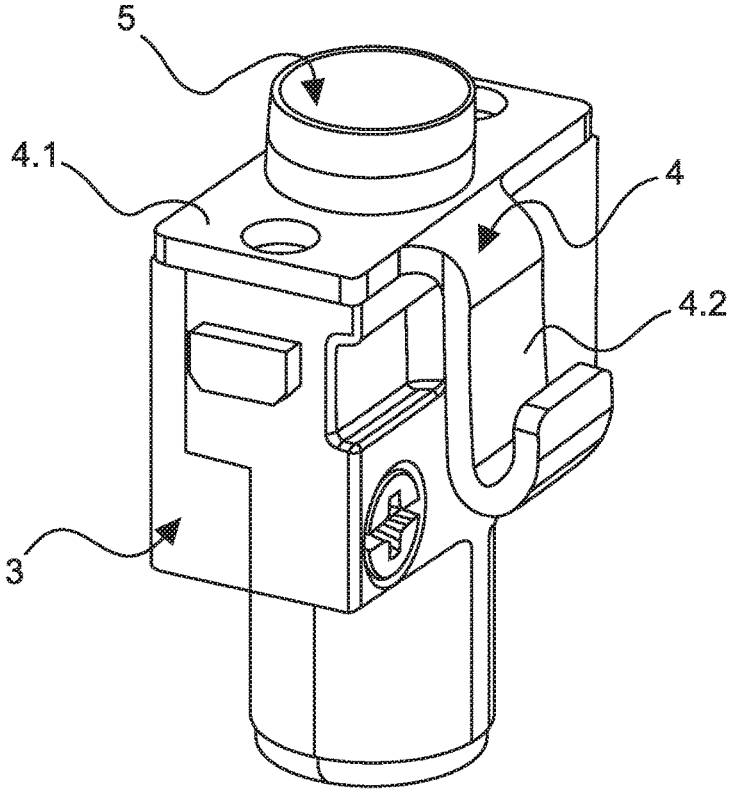
FIG. 2 shows a plug connector module according to the disclosure with the grounding device.

A plug connector module 3 with a grounding device 4 provided thereon and a contact element 5 accommodated in the plug connector module 3 is shown in FIG. 2. The grounding device 4 is arranged with its fastening flange 4.1 on a connection side (shown at the top) of the plug connector module 3. The fastening bores 4.4 are provided to receive screws which fasten the fastening flange 4.1 on the plug connector module 3.

The contact element 5 accommodated in the plug connector module 3 projects through the contact opening 4.5 of the grounding device 4. Access is thus permitted to the connection side (visible here and designed as a crimp connection) of the contact element 5. The plug connector module 3 shown is formed from two metal or at least electrically conductive housing halves. The whole plug connector module 3 thus serves as a grounding contact in the modular plug connector.

The spring arm 4.2 of the grounding device 4 extends along the plug connector module 3. The free end 4.3, bent into a U shape, of the spring arm 4.2 here extends away from the plug connector module 3. The spring arm 4.2 extends as far as approximately half the length of the plug connector module 3. A gap, in which parts of a housing 1 (FIG. 3) of a modular plug connector could be accommodated, is provided between the spring arm 4.2 and the plug connector module 3.

In an alternative embodiment, the spring arm 4.2 can also touch the plug connector module 3 in the region of its free end 4.3. As a result of the springy elastic material from which the grounding device 4 is made, the spring arm 4.2 can thus be moved away from the plug connector module 3 and resiliently clamp a region of the housing 1 between the grounding device 4 and the plug connector module 3.

Figure 3:
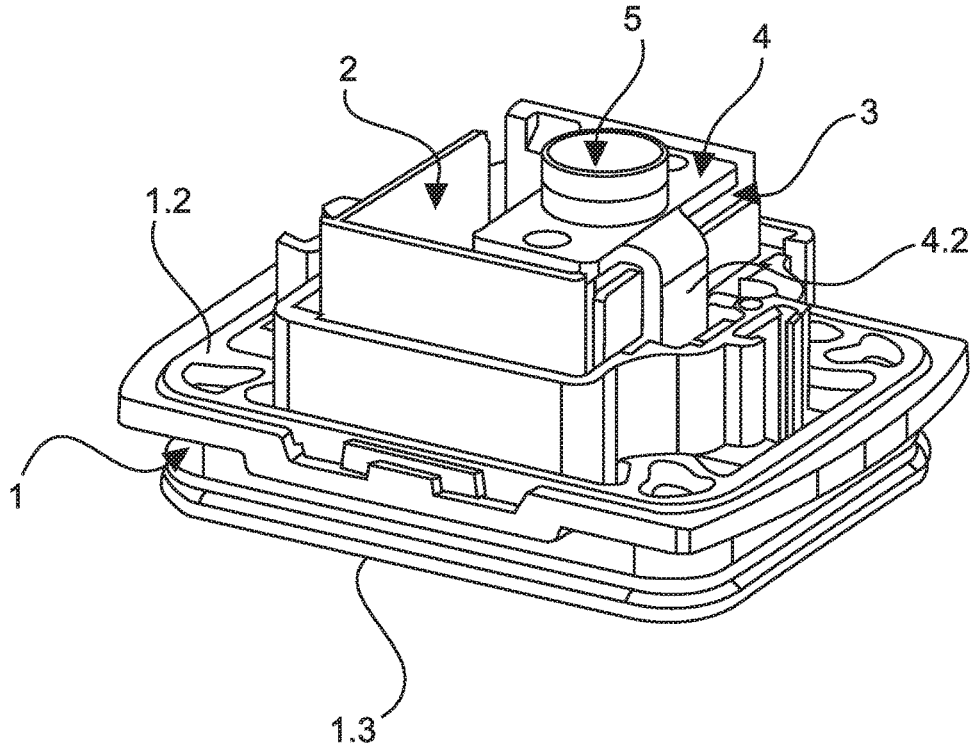
FIG. 3 shows a modular plug connector according to the disclosure with the plug connector module and the grounding device.

The plug connector module 3 with the grounding device 4 and contact element 5 are shown in FIG. 3 as a structural unit, incorporated in a housing 1 of a modular plug connector. The modular plug connector is formed from a housing 1. The housing 1 is designed in this embodiment as a so-called mounting housing. This means that the housing 1 can be inserted into an opening of an appliance or an appliance wall. The housing 1 does not have a cable outlet for the supply of a cable. Embodiments of the present invention can also be transferred or applied to such housings of modular plug connectors.

On the side shown at the bottom, the metal housing 1 has a plug side 1.3 which serves for contacting with a mating plug connector. On the side shown at the top, the housing 1 forms a connection side on which cables can be connected to the contact elements 5 of inserted plug connector modules 3.

On the connection side, the housing 1 additionally has a seal 1.2 which enables the housing 1 to be sealed in the mounted state against environmental influences. A retaining frame 2 is provided inside the housing 1. The retaining frame 2 is fastened mechanically in the housing 1. In contrast to the metal housing 1, the retaining frame 2 is made from plastic or at least an electrically insulating material. Electrical separation of the plug connector modules 3 from the housing 1 is enabled as a result.

The plug connector modules 3—only one is shown here—are in turn accommodated and fixed mechanically in the retaining frame 2. The plug connector module 3 shown is accommodated in an outer position of the retaining frame 2. As a result, the spring arm 4.2 of the grounding device 4 can engage over the retaining frame 2 and contact the housing 1. The U-shaped free end 4.3 of the spring arm 4.2 provides at least two contact points with the housing 1. They can be seen more clearly in FIG. 4.

Figure 4:
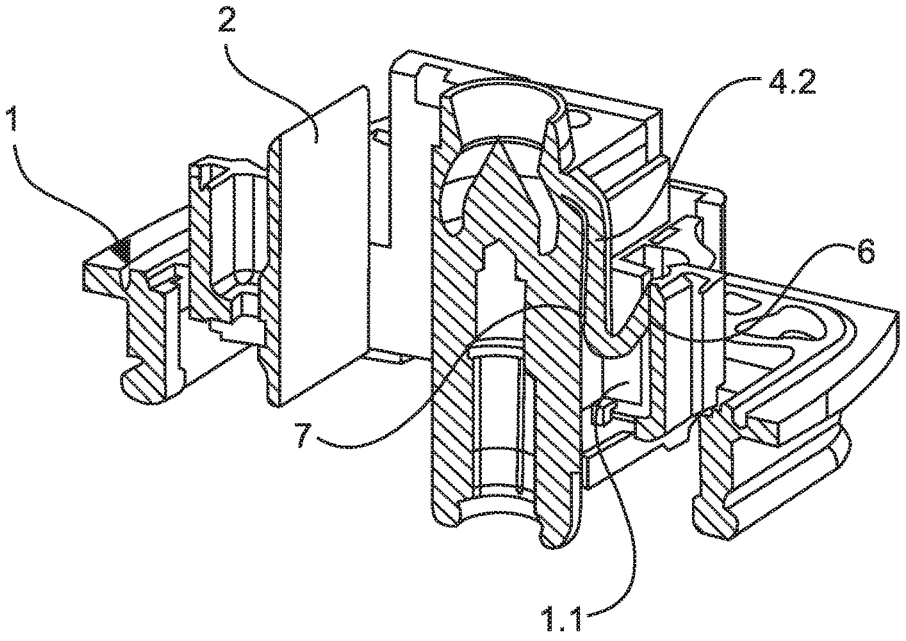
FIG. 4 shows a section through the modular plug connector in FIG. 3.

FIG. 4 shows the modular plug connector from FIG. 3 in a view in section along the long side, through all the components of the modular plug connector. A pocket 1.1 which is formed by the housing 1 can be seen. The free end 4.3 of the spring arm 4.2 engages over the retaining frame 2 into this pocket 1.1. The U-shaped free end 4.3 thus contacted the housing 1 inside the pocket 1.1 at two opposite contact points 6, 7.

The pocket 1.1 of the housing 1 can be a single part with the housing 1 or, as in FIG. 4, be an integral part of the housing 1 only on four sides. A fifth side, which forms the contact point 7, is here formed by a grounding plate in the housing 1.

The free end 4.3 can thus exert a sufficient force for electrical contact with the housing 1. As a result, a reliable electrical contact between the contact element 5, via the plug connector module 3 and the grounding device 4, and the housing 1 is enabled. The electrically insulating retaining frame 2 is bridged by the grounding device 4. Insulation of further ungrounded plug connector modules is moreover ensured. Only one plug connector module 3, which is equipped with a grounding device 4, is electrically connected to the housing 1.

Figure 5:
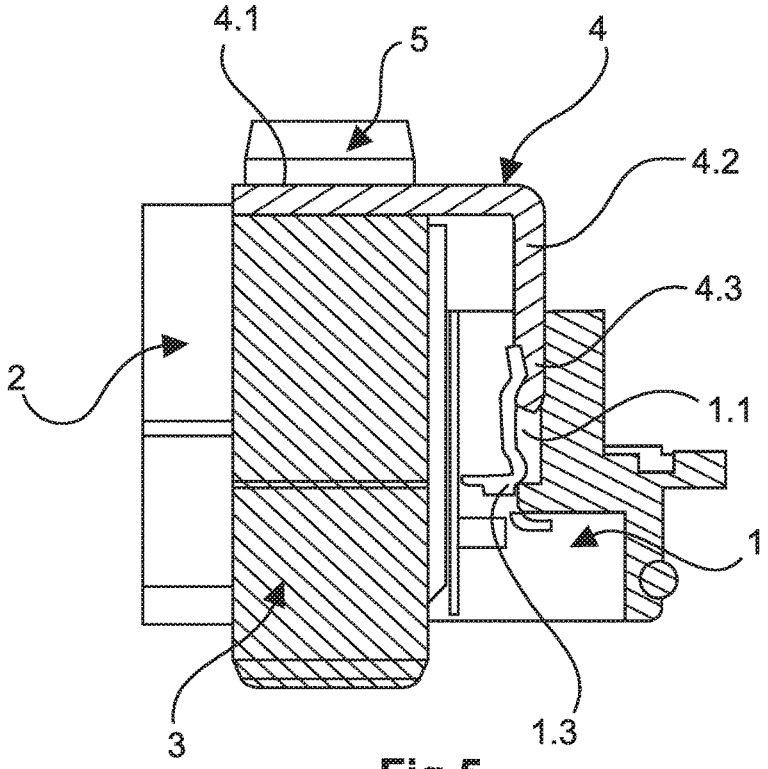
FIG. 5 shows a further embodiment of a modular plug connector according to the disclosure in section.

A further embodiment of a modular plug connector according to the present disclosure is shown in section in FIG. 5. In this embodiment, the free end 4.3 of the spring arm 4.2 is here designed as straight. In order to produce a positive contact of the spring arm 4.2 with the housing 1, a spring plate 1.3 is provided in the pocket 1.1 of the housing 1. The spring plate 1.3 is arranged such that it exerts a force on the free end 4.3 of the spring arm 4.2. The latter is thus pressed against the housing 1 and produces an electrical contact.

Figure 6:
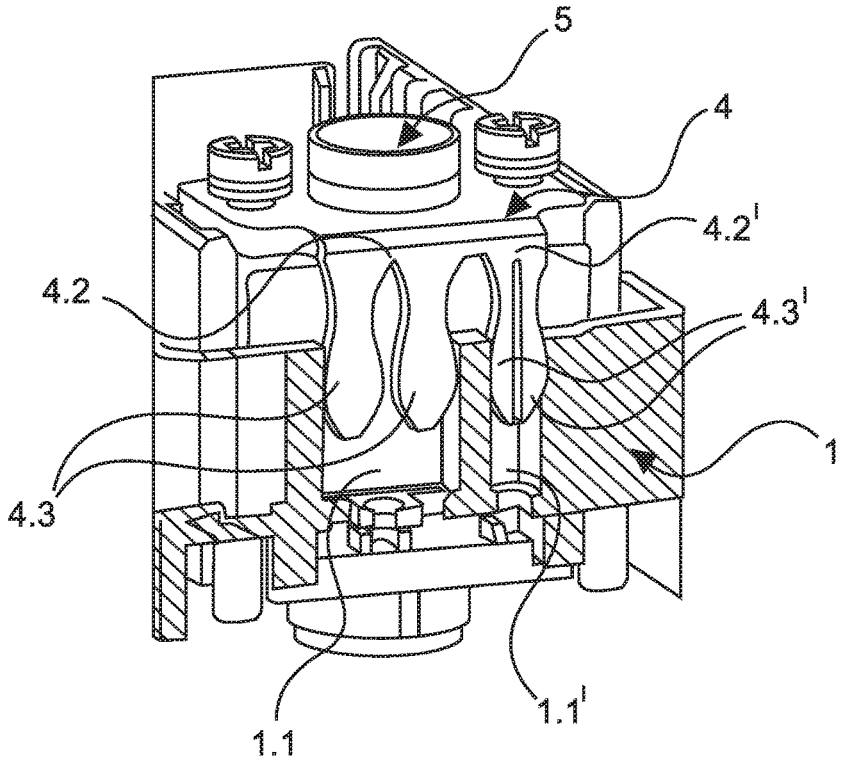
FIG. 6 shows yet a further embodiment of a modular plug connector according to the disclosure in section.

A further embodiment according to the present disclosure is shown in FIG. 6. This Figure, likewise shown in section, shows a spring arm 4.2 which is formed from two free ends

4.3. The free ends 4.3 are arranged in a springy elastic fashion relative to one another. The free ends 4.3 of the spring arm 4.2 can thus be inserted into the pocket 1.1 of the housing 1 and, by virtue of their spring action relative to one another, produce a positive electrical contact between the grounding device 4 and the housing 1. In this particular embodiment, two spring arms 4.2, 4.2' which each engage in a pocket 1.1, 1.1' of the housing 1 are integrally formed on the grounding device 4. Twice the number of contact points can thus be produced and a better electrical contact ensured.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A modular plug connector comprising:

a metal housing;

an electrically insulating retaining frame; and at least one plug connector module inserted into the retaining frame, wherein:

the retaining frame is arranged in the housing, the at least one plug connector module is made from a metal or at least an electrically conductive material, forms a plug side and a connection side, and at least one electrical contact is accommodated in the plug connector module, the modular plug connector has a grounding device which connects the at least one plug connector module electrically to the metal housing, the grounding device is formed from a flat fastening flange on which a spring arm is integrally formed, the fastening flange of the grounding device is fastened on the connection side of the plug connector module, and the spring arm of the grounding device is in touching contact with the housing.

2. The modular plug connector as claimed in claim 1, wherein the spring arm has a free end which has an approximate U shape in design.

3. The modular plug connector as claimed in claim 1, wherein the spring arm has a free end which is formed from two spring regions which are springy relative to one another.

4. The modular plug connector as claimed in claim 1, wherein the spring arm is oriented approximately at a right angle to the fastening flange.

5. The modular plug connector as claimed in claim 1, wherein the fastening flange is fastened to the plug connector module by at least one screw.

6. The modular plug connector as claimed in claim 1, wherein the spring arm has at least two contact points with the housing.

7. The modular plug connector as claimed in claim 6, wherein the two contact points are opposite each other on the housing and the spring arm is arranged positively between the two contact points.

8. The modular plug connector as claimed in claim 6, wherein one of the contact points is formed on the housing between the spring arm and a grounding plate.

9. The modular plug connector as claimed in claim 1, wherein the spring arm of the grounding device is accommodated in a pocket of the housing.

* * * * *